US008113288B2

(12) United States Patent
Bachtell et al.

(10) Patent No.: US 8,113,288 B2
(45) Date of Patent: Feb. 14, 2012

(54) SYSTEM AND METHOD FOR OPTIMIZING PRODUCTION IN GAS-LIFT WELLS

(76) Inventors: David Bachtell, White Oak, TX (US); Charles Bachtell, Longview, TX (US); Mike Bachtell, Bossier City, LA (US)

( * ) Notice: Subject to any disclaimer, the term of this patent is extended or adjusted under 35 U.S.C. 154(b) by 107 days.

(21) Appl. No.: 12/686,614

(22) Filed: Jan. 13, 2010

(65) Prior Publication Data

US 2011/0168413 A1 Jul. 14, 2011

(51) Int. Cl.
*E21B 43/40* (2006.01)

(52) U.S. Cl. ..... 166/372; 166/90.1; 166/105.6; 166/252.1; 166/309

(58) Field of Classification Search ..... None
See application file for complete search history.

(56) References Cited

U.S. PATENT DOCUMENTS

| | | | |
|---|---|---|---|
| 4,267,885 | A | 5/1981 | Sanderford |
| 4,453,568 | A | 6/1984 | Canalizo |
| 4,545,731 | A | 10/1985 | Canalizo et al. |
| 4,596,516 | A | 6/1986 | Scott et al. |
| 5,066,198 | A | 11/1991 | Decker |
| 5,069,242 | A | 12/1991 | Kilgore |
| 5,172,717 | A | 12/1992 | Boyle et al. |
| 5,176,164 | A | 1/1993 | Boyle |
| 5,522,418 | A | 6/1996 | Johnson et al. |
| 5,634,522 | A | 6/1997 | Hershberger |
| 5,707,214 | A | 1/1998 | Schmidt |
| 5,826,659 | A | 10/1998 | Hershberger |
| 5,871,048 | A | 2/1999 | Tokar et al. |
| 5,896,924 | A | 4/1999 | Carmody et al. |
| 5,915,478 | A | 6/1999 | Brown et al. |
| 5,937,945 | A | 8/1999 | Bussear et al. |
| 6,182,756 | B1 | 2/2001 | Garcia et al. |
| 6,352,109 | B1 | 3/2002 | Buckman, Sr. |
| 6,454,002 | B1 | 9/2002 | Stokes et al. |
| 6,491,105 | B2 | 12/2002 | Holt, Jr. |
| 6,511,041 | B2 | 1/2003 | Faustinelli |
| 6,516,879 | B1 | 2/2003 | Hershberger |
| 6,568,473 | B2 | 5/2003 | de Almeida |
| 6,568,478 | B2 | 5/2003 | De Almeida |
| 6,595,294 | B1 | 7/2003 | Dalsmo et al. |
| 6,705,397 | B2 | 3/2004 | Hershberger |
| 6,715,550 | B2 | 4/2004 | Vinegar et al. |
| 6,758,277 | B2 | 7/2004 | Vinegar et al. |
| 6,807,501 | B1 | 10/2004 | Hyde |
| 6,854,518 | B1 | 2/2005 | Senyard, Sr. et al. |
| 6,863,125 | B2 | 3/2005 | Ivannikov et al. |
| 6,932,581 | B2 | 8/2005 | Messick |
| 7,086,417 | B2 | 8/2006 | De Almeida |
| 7,147,059 | B2 | 12/2006 | Hirsch et al. |
| 7,308,952 | B2 | 12/2007 | Strazhgorodskiy |
| 7,360,602 | B2 | 4/2008 | Kritzler et al. |
| 7,363,983 | B2 | 4/2008 | Martinez et al. |
| 7,370,706 | B2 | 5/2008 | Becker et al. |
| 7,464,763 | B2 | 12/2008 | Galloway et al. |
| 2009/0229831 | A1 * | 9/2009 | Zupanick ..... 166/372 |

* cited by examiner

*Primary Examiner* — Zakiya W Bates
(74) *Attorney, Agent, or Firm* — Mark D. Perdue

(57) ABSTRACT

The system and method are utilized to control the flow of crude oil, natural gas, and field produced salt water to optimize production from an oil or gas well. The invention is suitable for use with a well that utilizes gas-lift as artificial lift. The equipment is designed to regulate the flow of injection gas into the production tubing to optimize production of the well.

18 Claims, 5 Drawing Sheets

SYSTEM AND METHOD FOR OPTIMIZING PRODUCTION IN GAS-LIFT WELLS

TECHNICAL FIELD OF THE INVENTION

This invention relates in general to optimizing the production of hydrocarbons from oil or gas wells and in particular to a system and method for regulating the flow of injection gas into the production tubing of one or more gas-lift wells.

BACKGROUND OF THE INVENTION

Without limiting the scope of the present invention, its background is described with reference to optimizing the production of hydrocarbons from a well that uses gas injection to artificially lift the fluid contained in the wellbore.

It is well known in the subterranean well operation arts that the natural pressure of the formation in which the well is completed may be or may become insufficient to produce fluids out of the wellbore, such that the fluids do not flow to the surface at an optimal volume flow rate or do not flow at all. In order to restore production to the optimal volume flow rate, therefore, an artificial method of producing the fluids through the wellbore must be implemented.

A common method used to increase or restore production to a well is a gas-lift system, whereby some of the gas produced from one or more wells is injected back into the production tubing of the well at one or more downhole locations. This effectively reduces the density of the fluid column in the wellbore, allowing the reservoir pressure to lift the fluid out of the wellbore.

In typical gas-lift wells, fluids produced from the production wellbore are routed into a separator tank on the surface. The separator may be fed by one or more production wells. Once separated from the water, oil, and other fluids produced from the reservoir, the gas is usually then routed to a compressor to increase its pressure. After the compression stage, the gas may be sent to a sales line, a gas-injection line, or both. Gas that is routed into the gas-injection line is injected into the fluid column in the production tubing of the wellbore of the gas-lift well. This is usually accomplished by installing gas-lift valves on the production tubing that allow the injection gas to be forced into the annulus and pass into the production tubing and the fluid column contained therein.

To maximize fluid production from a gas-lift well, the volume flow rate of the injection gas must be maintained at an optimum level. In typical gas lift systems, however, some gas is sent to the sales line even if the optimum volume flow rate of injection gas has not been reached. Thus, the well may produce below the optimum level for an extended time. Further, because both sales gas and injection gas are compressed, the power requirements of the compressor fluctuate with fluctuations in the volume flow rate of gas produced by the well.

It is an object of the present invention, therefore, to prioritize maintaining the optimum level of gas production using the gas-lift process over sending gas into the sales line when the well is not producing gas at the optimum rate due to decreases in formation pressure.

SUMMARY OF THE INVENTION

Accordingly, the present invention provides a system and method for regulating the flow of injection gas into the production tubing of a gas-lift well.

In one aspect, the present invention is directed to a system and method for regulating the flow of injection gas into the fluid column within the production tubing of the gas-lift well when the volume flow rate of gas flowing from the well into the separator equals or exceeds the desired volume flow rate of gas entering the gas-injection line for injecting into the production tubing, and the non-gaseous fluid level of the separator is below a predetermined maximum level. Gas is constantly sent from the separator into the gas-injection line at the desired volume flow rate for injection gas, and if the volume flow rate of gas flowing from the well into the separator exceeds the desired volume flow rate of injection gas, the remaining gas and other fluids produced by the well are sent into a sales line.

In another aspect, the present invention is directed to a system and method for regulating the flow of injection gas into the fluid column within the production tubing of the gas-lift well when the volume flow rate of gas flowing from the well into the separator is less than the desired volume flow rate of gas entering the gas-injection line for injecting into the production tubing, and the non-gaseous fluid level of the separator is below a predetermined maximum level. Some gas is constantly sent from the separator into the gas-injection line at less than the desired volume flow rate for injection gas, and the remaining gas is sent from the separator into a make-up gas line that routs the gas back into the separator.

In a further aspect, the present invention is directed to a system and method for regulating the flow of injection gas into the fluid column within the production tubing of the gas-lift well when the non-gaseous fluid level of the separator is above a predetermined maximum level. The gas lift process is temporarily suspended to dump the excess non-gaseous fluid from the separator into a sales line.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
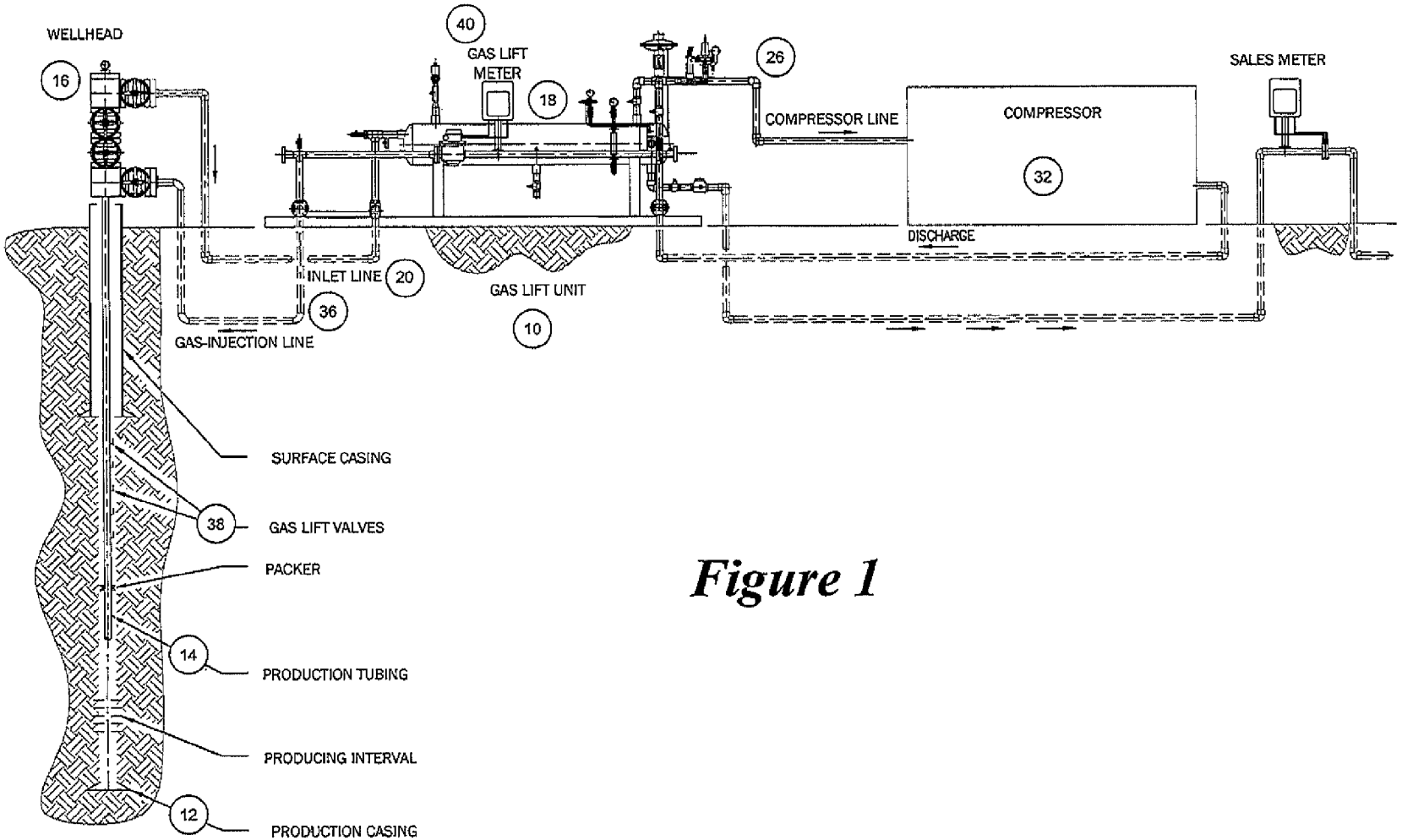
FIGS. 1 and 2 are schematic illustrations of an apparatus for separating and compressing gas produced from a single well and injecting it back into the fluid column within the production tubing of the well of the present invention.
Figure 2:
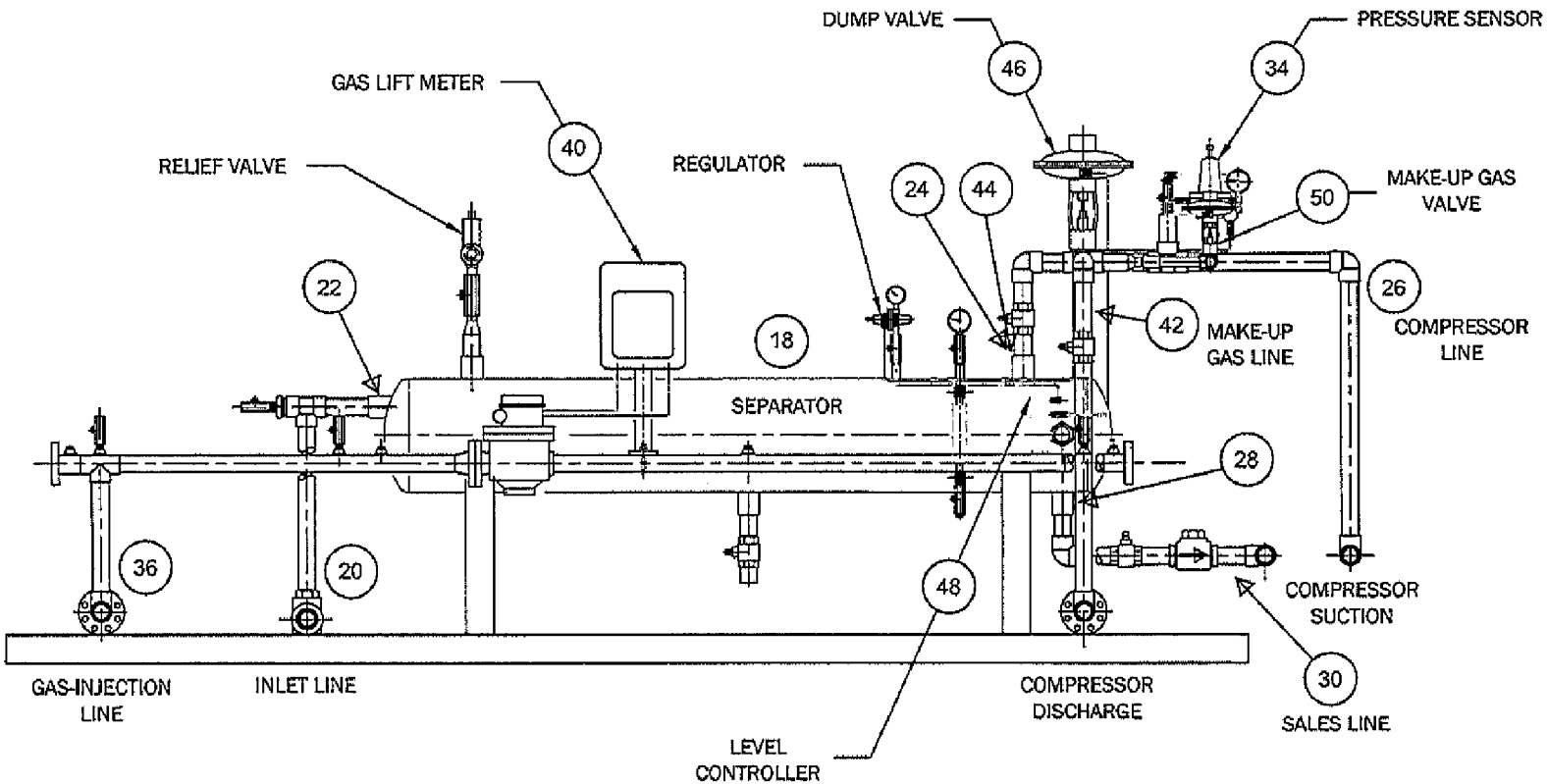

Referring initially to FIGS. 1 and 2, an apparatus for separating gas produced from a single production and gas-lift well and injecting gas into the fluid column within the production tubing of the gas-lift well is schematically illustrated and generally designated at 10. Gas, oil, saltwater, and other fluids produced in production casing 12 are transported to the surface inside production tubing 14, which is supported by wellhead 16. At wellhead 16, the fluids are directed into separator 18 through inlet line 20 that connects to inlet 22. Separator 18 is equipped with first outlet 24 for directing gas into compressor line 26 and second outlet 28 for directing gas into sales line 30. Compressor line 26 directs gas into compressor 32. Pressure sensor 34 located on compressor line 26 measures the suction pressure of compressor 32.

Still referring to FIGS. 1 and 2, and as further explained in more detail below, gas exiting compressor 32 may be routed through gas-injection line 36, which directs the gas back into production tubing 14 through one or more gas lift valves 38 located on production tubing 14. Gas lift meter 40 records the pressure and volume flow rate of gas that is injected for gas lift via gas-injection line 36. Gas exiting compressor 32 may also be routed through make-up gas line 42 that feeds back into separator 18 via make-up gas inlet 44. Dump valve 46 is located on make-up gas line 42 and is actuated by level controller 48, which measures the non-gaseous fluid level in separator 18. Make-up gas valve 50 is located on make-up gas line 42 in parallel with dump valve 46. Make-up gas valve 50 is actuated by pressure sensor 34, which measures the suction pressure of compressor 32, which is approximately equal to the pressure within separator 18.

Even though FIG. 1 depicts a single well that supplies produced or production fluids (production well) and is the recipient of injected gas (gas-lift well), it should be noted by those skilled in the art that the system and method for regulating the flow of injection gas of the present invention are equally well-suited for use in systems wherein production from multiple wells flows into a single separator or where a single separator and/or compressor supplies gas to multiple gas-lift wells Further, even though FIG. 1 depicts a vertical well, it should be noted by those skilled in the art that the system and method for regulating the flow of injection gas of the present invention are equally well-suited for use in deviated wells, inclined wells, or horizontal wells. Still further, even though FIG. 1 depicts an onshore operation, it should be noted by those skilled in the art that the system and method for regulating the flow of injection gas of the present invention are equally well-suited for offshore operations.

Figure 3:
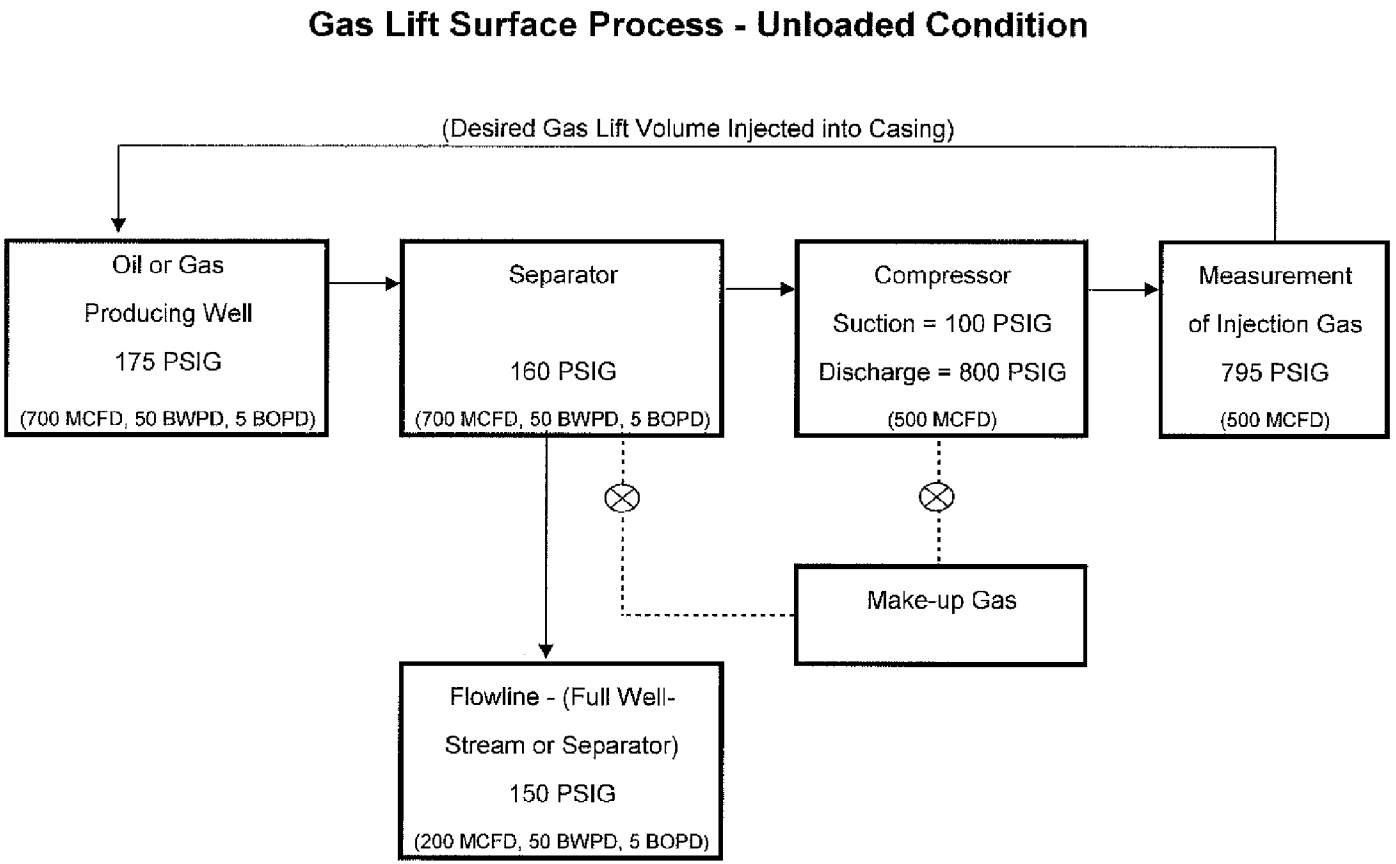
FIG. 3 is a flow chart depicting the method of the present invention when the volume flow rate of gas flowing from the well into the separator equals or exceeds the desired volume flow rate of gas entering the gas-injection line, and the non-gaseous fluid level of the separator is below a predetermined maximum level and in which the preferred volume flow rate of injection gas is 500 thousand cubic feet per day.

Referring now to FIG. 3, therein is depicted an aspect of the present invention in which the well is in the "unloaded condition," that is, when the volume flow rate of gas flowing from the well into separator 18 equals or exceeds the desired volume flow rate of gas in gas-injection line 36 for injecting into production tubing 14 and the non-gaseous fluid level of separator 18 is below a predetermined maximum level. In a preferred embodiment, the unloaded condition is indicated when the pressure of separator 18 as indicated by pressure sensor 34 equals or exceeds a predetermined minimum value and the non-gaseous fluid level of separator 18 measured by level controller 48 is below a predetermined maximum level. It should be apparent to those skilled in the art, however, that the unloaded condition may be indicated by a variety of means.

When the well of the present invention is in the unloaded condition, gas produced from the well is routed into separator 18. Gas exits separator 18 via first outlet 24 and is directed through compressor line 26 into compressor 32. In a preferred embodiment, compressor 32 is sized or configured such that its maximum discharge volume flow rate equals the desired volume flow rate of gas in gas-injection line 36 to be injected into production tubing 14. Dump valve 46 is closed, and make-up gas valve 50 is closed. Thus, compressor 32 will constantly send gas into gas-injection line 36 at the desired injection volume flow rate as long as the volume flow rate of fluids produced by the well equals or exceeds the desired injection volume flow rate. If the volume flow rate of gas entering separator 18 equals the maximum discharge volume flow rate of compressor 32, then no fluids in separator 18 enter sales line 30. If the volume flow rate of gas entering separator 18 exceeds the maximum discharge volume flow rate of compressor 32, then the fluids remaining in separator 18 exit separator 18 via second outlet 28 and into sales line 30.

In the example of FIG. 3, the desired volume flow rate of gas in gas-injection line 36 for injecting into production tubing 14 is about 500 thousand cubic feet per day ("MCFD"). In the example depicted, the volume flow rate of gas flowing from the well into separator 18 is about 700 MCFD, the volume flow rate of saltwater produced is about 50 barrels of saltwater per day ("BWPD"), and the volume flow rate of oil produced is about 5 barrels of oil per day ("BOPD"). In the example depicted, the predetermined maximum level of non-gaseous fluids in separator 18 is not exceeded. The pressure of separator 18 is about 160 psig, which exceeds the predetermined minimum value for maintaining the unloaded condition in the embodiment depicted. Compressor 32 is sized or configured such that its maximum discharge flow rate equals 500 MCFD, which corresponds to the desired injection flow rate.

Figure 4:
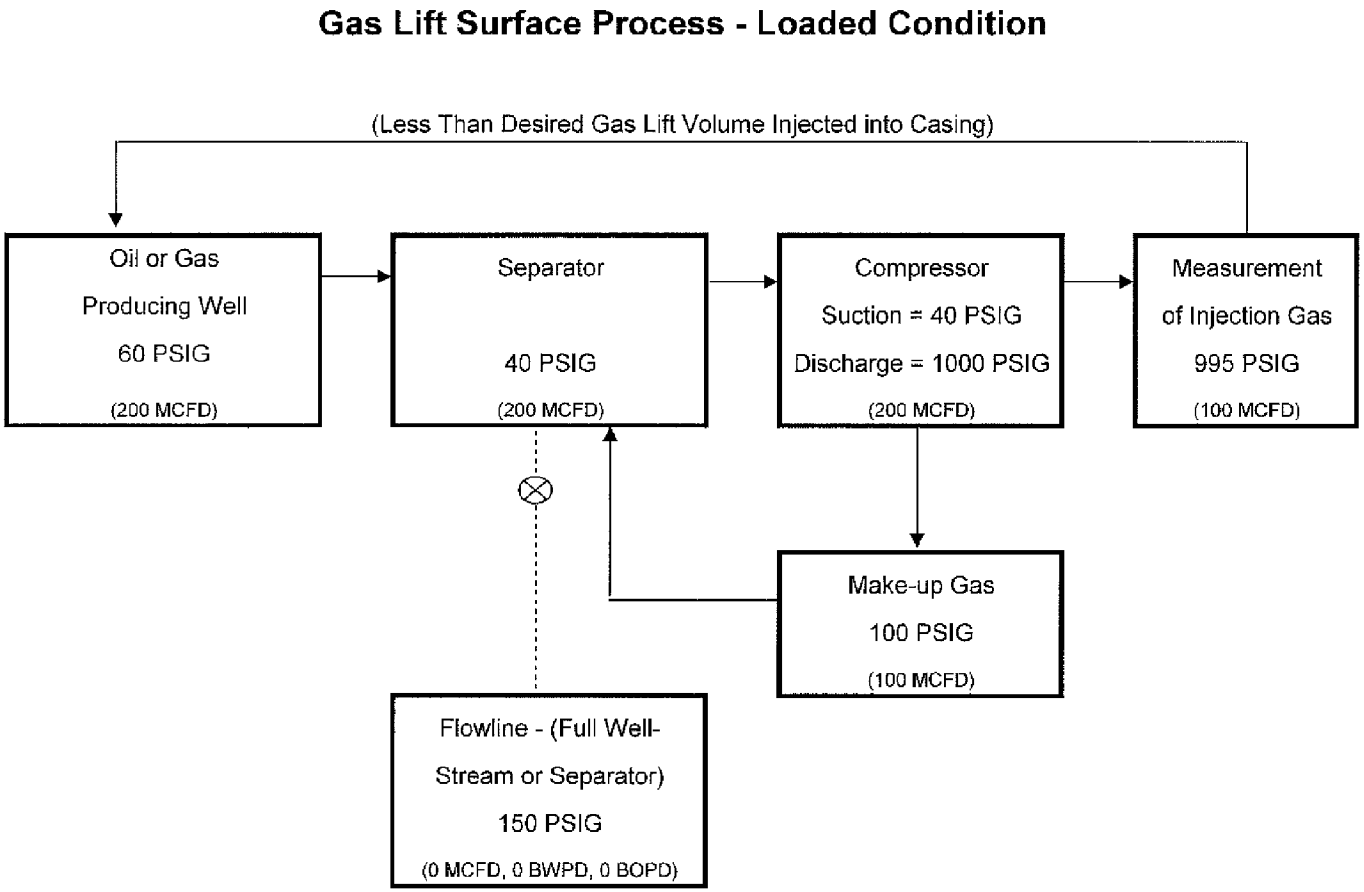
FIG. 4 is a flow chart depicting the method of the present invention when the volume flow rate of gas flowing from the well into the separator is less than the desired volume flow rate of gas entering the gas-injection line, and the non-gaseous fluid level of the separator is below a predetermined maximum level and in which the preferred volume flow rate of injection gas is 500 thousand cubic feet per day.

Again, because the unloaded condition exists in the example depicted in FIG. 4, dump valve 46 is closed and make-up gas valve 50 is closed. Thus, compressor 32 will constantly send gas into gas-injection line 36 at about 500 MCFD as long as the volume flow rate of gas produced by the well equals or exceeds said desired injection volume flow rate of 500 MCFD. In the example depicted, the volume flow rate of gas produced at wellhead 16 is about 700 MCFD, therefore, the remaining gas in separator 18, equal to about 200 MCFD, is sent to sales line 30, along with the saltwater and oil in separator 18.

FIG. 4 depicts a second aspect of the present invention in which the well is in the "loaded condition," that is, when the volume flow rate of gas flowing from the well into separator 18 is less than the desired volume flow rate of gas in gas-injection line 36 and the non-gaseous fluid level of separator 18 is below a predetermined maximum level. In a preferred embodiment, the loaded condition is indicated when the suction pressure of compressor 32 as indicated by pressure sensor 34 is below a predetermined minimum value and the non-gaseous fluid level of separator 18 measured by level controller 48 is below a predetermined maximum level. It should be apparent to those skilled in the art, however, that the loaded condition may be indicated by a variety of means.

When the well of the present invention is in the loaded condition, fluids produced from the well are routed into separator 18. Gas exits separator 18 via first outlet 24 and is directed through compressor line 26 into compressor 32. Dump valve 46 is closed and make-up gas valve 50 is open. Thus, gas exits compressor 32 to both gas-injection line 36 and make-up gas line 42. Gas entering gas-injection line 36 is routed into production tubing 14 through gas lift valves 38.

Gas entering make-up gas line 42 is routed into separator 18 via make-up gas inlet 44. Once the volume flow rate of gas produced by the well and flowing into separator 18 equals or exceeds the desired volume flow rate of gas for injecting into production tubing 14, make-up gas valve 50 is closed, thereby cutting off the gas flow from compressor 32 to make-up gas line 42, and the well of the present invention is again in the "unloaded" condition.

In the example of FIG. 4, the desired volume flow rate of gas for injecting into production tubing 14 is about 500 MCFD. In the example depicted, the volume flow rate of gas flowing from the well into separator 18 is about 200 MCFD. The predetermined maximum level of non-gaseous fluids in separator 18 is not exceeded, however, the pressure of separator 18 is about 40 psig, which is less than the predetermined minimum value for maintaining the unloaded condition in the preferred embodiment depicted in FIG. 4.

Because the loaded condition exists, make-up gas valve 50 is open. Dump valve 46 is closed. Gas flows through gas-injection line 36 at about 100 MCFD and make-up gas line 42 at about 100 MCFD. Gas entering gas-injection line 36 is routed into production tubing 14 through gas lift valves 38. Gas entering make-up gas line 42 is routed into separator 18 via make-up gas inlet 44. Once the volume flow rate of gas produced by the well and flowing into separator 18 equals or exceeds 500 MCFD, make-up gas valve 50 is closed, and the well is again in the "unloaded" condition.

Figure 5:
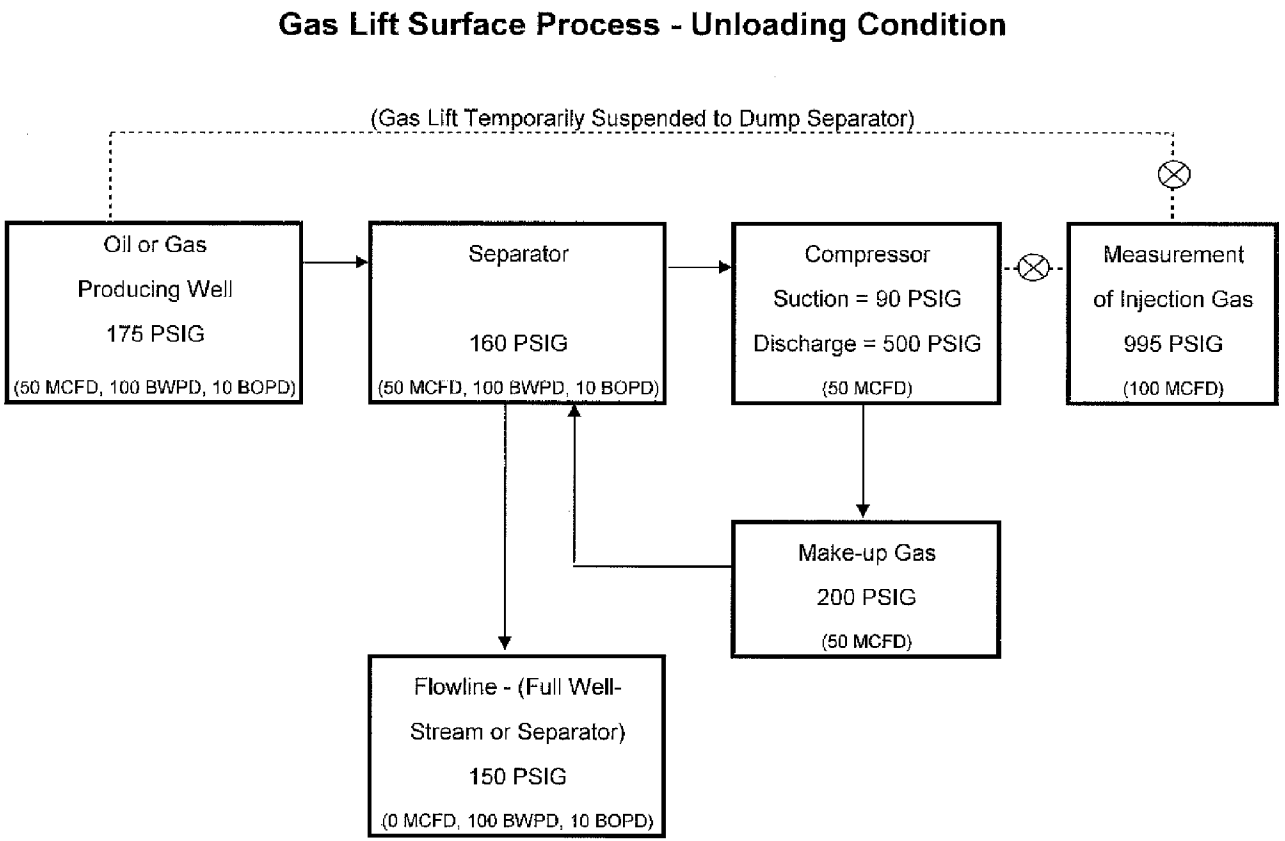
FIG. 5 is a flow chart depicting the method of the present invention when the non-gaseous fluid level of the separator is above a predetermined maximum level and in which the preferred volume flow rate of injection gas is 500 thousand cubic feet per day.

FIG. 5 depicts a third aspect of the present invention in which the well is in the "unloading condition," that is, when the non-gaseous fluid level of separator 18 exceeds a desired maximum non-gaseous fluid level. When the unloading condition exists, the gas lift process is temporarily suspended to dump the excess non-gaseous fluids from separator 18. In a preferred embodiment, the unloading condition is indicated when the non-gaseous fluid level of separator 18 measured by level controller 48 is above a predetermined maximum level. It should be apparent to those skilled in the art, however, that the unloading condition may be indicated by a variety of means.

When the well of the present invention is in the unloading condition, fluids produced from the well are routed into separator 18. Gas exits separator 18 via first outlet 24 and is directed through compressor line 26 into compressor 32. Make-up gas valve 50 is open and dump valve 46 is open. Thus, gas exits compressor 32 only to make-up gas line 42 and is routed into separator 18 via make-up gas inlet 44, and excess non-gaseous fluids are continually dumped from separator 18 into sales line 30. This process continues until the non-gaseous fluid level of separator 18 is equal to or below a predetermined maximum level, at which point dump valve 46 is closed.

In the example of FIG. 5, the volume flow rate of gas flowing from the well into separator 18 is about 50 MCFD, the volume flow rate of saltwater produced at wellhead 16 is about 100 BWPD, and the volume flow rate of oil produced at wellhead 16 is about 10 BOPD. In the present example, the unloading condition is indicated by level controller 48, which detects that the level of non-gaseous fluids in separator 18 is above a predetermined maximum level.

Because the unloading condition exists in the example depicted, dump valve 46 is open. Make-up gas is continually routed into separator 18 via make-up gas inlet 44 and excess non-gaseous fluids are continually dumped from separator 18 into sales line 30. This process continues until the non-gaseous fluid level of separator 18 is equal to or below the predetermined maximum level, at which point dump valve 46 is closed.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A method of injecting gaseous fluid produced from a production well into a gas-lift well at a selected injection volume flow rate, the method comprising the steps of:

accumulating gaseous and non-gaseous fluids from the production well in a separator;

compressing the gaseous fluid from the separator;

injecting the compressed gaseous fluid into the gas-lift well at or below the injection volume flow rate;

sensing a volume flow rate of gaseous fluid from the separator into the compressor;

diverting compressed gaseous fluid out of the compressor and into the separator if the sensed volume flow rate of gaseous fluid from the separator into the compressor is at or below the injection volume flow rate; and diverting flow of the non-gaseous fluid out of the separator into a sales line if the sensed volume flow rate of gaseous fluid from the separator into the compressor is above the injection volume flow rate.

2. The method according to claim 1, wherein the producing well and the gas-lift well are the same.

3. The method according to claim 1, wherein the producing well comprises a plurality of producing wells.

4. The method according to claim 1, wherein the gas-lift well comprises a plurality of gas-lift wells.

5. The method according to claim 1, wherein the step of sensing the volume flow rate of gaseous fluid from the separator into the compressor is performed by a flow rate sensor coupled between the separator and compressor.

6. A method of injecting gaseous fluid produced from a production well into a gas-lift well at a selected injection volume flow rate, the method comprising the steps of:

accumulating gaseous and non-gaseous fluids from the production well in a separator;

compressing the gaseous fluid from the separator;

sensing a volume of accumulated non-gaseous fluid in the separator;

diverting compressed gaseous fluid out of the compressor and into the separator and discharging the non-gaseous fluid from the separator if the sensed volume of accumulated non-gaseous fluid is in excess of a selected level; and if the sensed volume of accumulated non-gaseous fluid is below the selected level:

injecting the compressed gaseous fluid into the gas-lift well at or below the injection volume flow rate;

sensing a volume flow rate of gaseous fluid from the separator into the compressor;

diverting compressed gaseous fluid out of the compressor and into the separator if the sensed volume flow rate of gaseous fluid from the separator in to the compressor is at or below the injection volume flow rate; and diverting flow of the non-gaseous fluid out of the separator into a sales line if the sensed volume flow rate of gaseous fluid from the separator into the compressor is above the injection volume flow rate.

7. The method according to claim 6, wherein the producing well and the gas-lift well are the same.

8. The method according to claim 6, wherein the producing well comprises a plurality of producing wells.

9. The method according to claim 6, wherein the gas-lift well comprises a plurality of gas-lift wells.

10. The method according to claim 6, wherein the step of sensing the volume of accumulated non-gaseous fluid in the separator is performed by a non-gaseous fluid level sensor in the separator.

11. The method according to claim 6, wherein the step of sensing the volume flow rate of gaseous fluid from the separator into the compressor is performed by a flow rate sensor coupled between the separator and compressor.

12. An apparatus for injecting gas from a producing well into a gas-lift well, the apparatus comprising:

a separator configured to receive separate gaseous and non-gaseous fluids produced by the producing well, the separator receiving gaseous fluid at a production volume flow rate;

a compressor having an inlet and an outlet, the inlet coupled to receive gaseous fluid from the separator and compress it, the outlet coupled to the gas-lift well to inject gaseous fluid into the gas-lift well at a selected injection volume flow rate;

a sales line coupled to the separator to discharge fluid from the separator when the volume of non-gaseous fluid in the separator exceeds a selected level or when the volume of non-gaseous fluid in the separator is below a selected level and the production volume flow rate of gaseous fluid into the separator is above a selected level;

a make-up line coupled to the outlet of the compressor and to the separator to selectively return compressed gaseous fluid to the separator when the production volume flow rate of gaseous fluid into the separator is below a selected level; and a non-gaseous fluid level sensor in the separator.

13. The apparatus according to claim 12, wherein the producing well and the gas-lift well are the same.

14. The apparatus according to claim 12, wherein the producing well comprises a plurality of producing wells.

15. The apparatus according to claim 12, wherein the gas-lift well comprises a plurality of gas-lift wells.

16. The apparatus according to claim 12, wherein a dump valve is coupled to the non-gaseous fluid level sensor, the sensor opening the dump valve when the level of non-gaseous fluid in the separator exceeds a selected level.

17. The apparatus according to claim 12, further comprising a flow rate sensor coupled between the separator and compressor.

18. The apparatus according to claim 17, wherein a make-up gas valve is coupled to the flow rate sensor, the sensor opening the make-up gas valve when the production volume flow rate of gaseous fluid falls below the injection flow rate of gaseous fluid.

* * * * *